United States Patent [19]

Itoi

[11] Patent Number: 4,502,155

[45] Date of Patent: Mar. 5, 1985

[54] OUTERWEAR AND BAG IN ONE

[76] Inventor: Toru Itoi, 861-11, Komatsuri-Cho, Kishwada-Shi, Osaka, Japan

[21] Appl. No.: 390,306

[22] Filed: Jun. 21, 1982

[51] Int. Cl.[3] ..... A41B 1/00

[52] U.S. Cl. ..... 2/115; 2/94

[58] Field of Search ..... 2/115, 85, 86, 108, 2/94, 88

[56] References Cited

U.S. PATENT DOCUMENTS

| | | | |
|---|---|---|---|
| 1,959,331 | 5/1934 | Bour | 2/94 |
| 2,165,348 | 7/1939 | Daiber | 2/94 |
| 4,307,470 | 12/1981 | Ezell | 2/85 |

*Primary Examiner*—Doris L. Troutman

*Attorney, Agent, or Firm*—McAulay, Fields, Fisher, Goldstein & Nissen

[57] ABSTRACT

There is disclosed an outerwear which is worn for sports, hiking or the like, having on its back portion a pocket capable of receiving therein the whole outerwear. That is, in the outerwear and bag in one according to the present invention, the bag portion is provided on the outer surface side of the back portion of the outerwear to enable receiving the whole outerwear into the bag portion, and straps for holding the bag portion are provided on the inner surface side of the back portion of the outerwear so that when wearing the outerwear, the straps may be shouldered to prevent the outerwear from being pulled backward by the weight of articles received into the bag portion.

11 Claims, 6 Drawing Figures

OUTERWEAR AND BAG IN ONE

BACKGROUND OF THE INVENTION

1. Field of the Invention

This invention relates generally to a garment convertible to a pack and in particular to a backpack.

During an outing, one sometimes encounters a rise in temperature. When for that reason a person removes a garment, this garment usually has to be carried by hand so that at least one hand is not free during the outing.

2. Summary of the Invention

It is therefore a primary object of the present invention to provide an article wherein outerwear is received into a bag portion provided on the outerwear and the bag is carried on the back by a carrying strap or carried by shouldering the strap.

It is a second object of the present invention to provide an article in which other belongings may be received into the bag portion for carrying the same.

It is a third object of the present invention to provide an article in which a strap used when the bag portion is carried on the back is designed so that it may be shouldered when the outerwear is worn thereby to prevent the outerwear from being pulled rearwardly by the weight of articles within the pocket bag.

BRIEF DESCRIPTION OF THE DRAWINGS

Other objects, features and advantages of the present invention will be apparent from the following detailed description in conjunction with the accompanying drawings, in which.

DESCRIPTION OF THE PREFERRED EMBODIMENTS

Figure 1:
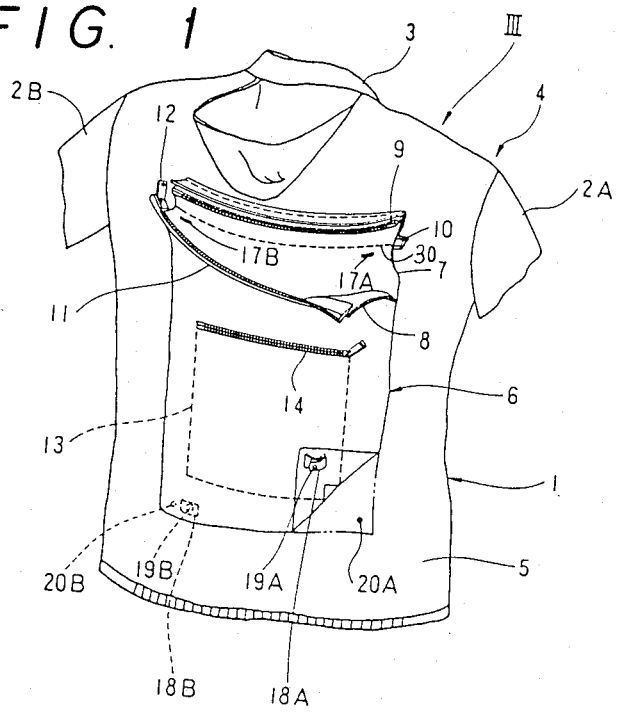
FIG. 1 is a rear view of an outerwear and bag in one in accordance with the present invention.
Figure 2:
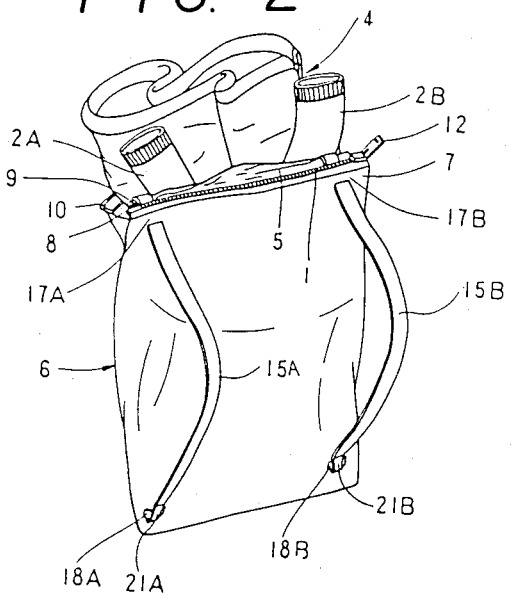
FIG. 2 is a view showing how to operate the outerwear and bag in one in accordance with the present invention.

As shown in FIG. 1, the outerwear and bag in one includes an outerwear 4 comprising an outerwear body 1, sleeves 2A and 2B, a collar or hood 3 and the like, and has a pocket or bag portion 6 provided on the outer surface of a back portion 5 (a portion on the back side of the body) of said body 1. This bag portion 6 whose upper edge is secured to the back portion 5 is formed by a pair of walls 7 and 8 opposite each other, and the walls 7 and 8 are sewn in the form of a bag with an opening at the top therearound. An open edge of one wall 7 forming an opening of the bag portion 6 is stitched by yarn 30 to the upper part of the back portion 5, the wall 7 having a first chuck web 9 provided on the open edge side thereof and a second chuck web 10 provided at the rear of the open edge of the wall 7. When wearing the outerwear 4, the first chuck web 9 is openably and closeably connected by a connector 12 to main chuck web 11 mounted on the open edge of the other wall 8. The second chuck web 10 is openably and closeably connected by the connector 12 of the main chuck web 11 when the whole outerwear 4 is received into the bag portion 6, as shown in FIG. 2. The outer wall 8 is provided with a smaller bag 13 than the pocket portion 6, and the pocket 13 is opened and closed by the chuck 14.

Figure 3:
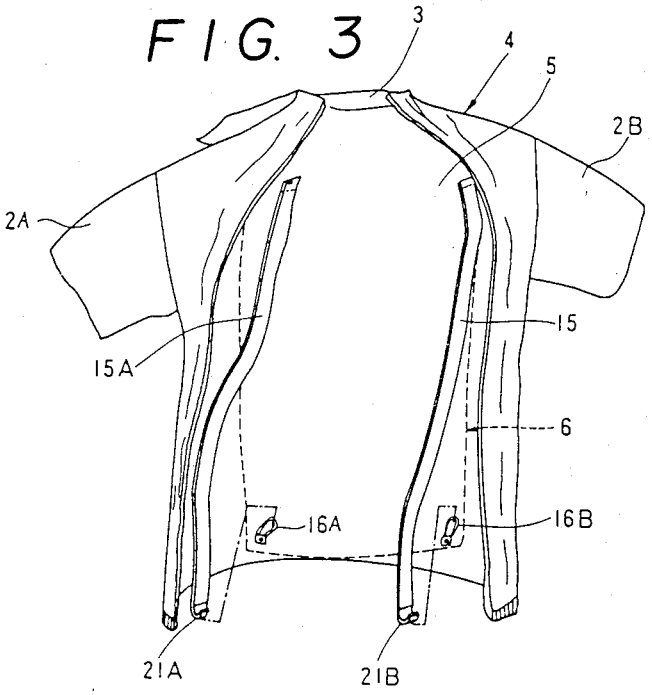
FIG. 3 is a front view of the outerwear and bag in one in accordance with the present invention.
Figure 4:
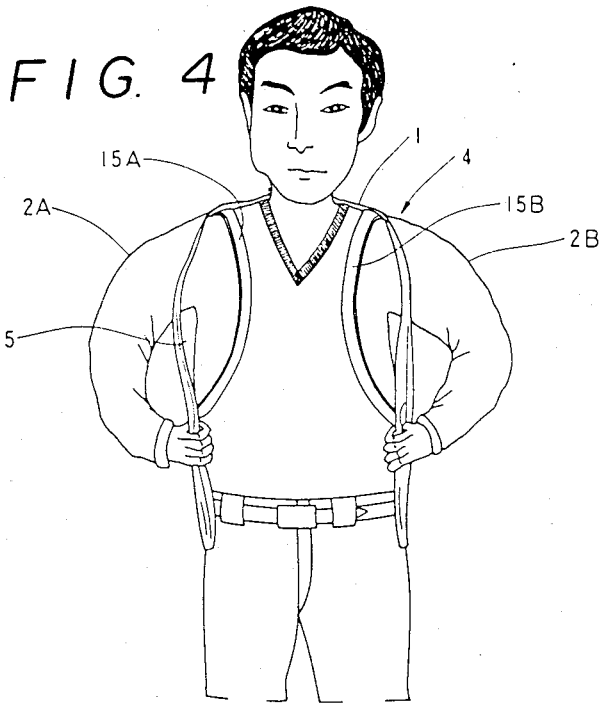
FIG. 4 is a front view showing the outerwear and bag in accordance with the present invention in use.

According to the present invention, there is provided a pair of carrying straps 15A and 15B, as shown in FIG. 3, said carrying straps 15A and 15B each having one end secured to left and right portions at the upper portion of the inner surface of the back portion 5. Portions to which straps 15A and 15B are secured substantially correspond to the open edge sides of the wall. The carrying straps 15A and 15B have their free ends respectively connected to loop-like engaging members 16A and 16B respectively provided on left and right sides at the lower part of the inner surface of the back portion 5, whereby as shown in FIG. 4, both arms of the wearer are passed through and between the respective carrying bands 15A and 15B and the back portion 5 and both the arms are passed through the sleeves 2A and 2B so that the outerwear may be worn with bag portion 6 on the back.

A pair of through-holes 17A and 17B are bored on left and right sides of the open edge of the inner wall 7 disposed on the side of the back portion 5 as shown in FIG. 1. Into the through-holes 17A and 17B are passed the free ends of the carrying straps 15A and 15B, respectively, disengaged from engaging members 16A and 16B, when the whole outerwear 4 is received into the bag portion 6 as shown in FIG. 2. In this case, the free ends of the straps 15A and 15B are passed from the inside to the outside of the bag portion 6 while extending over the first chuck web 9, and the free ends of the carrying straps 15A and 15B passed through the through-holes 17A and 17B, respectively, are detachably connected to engaging members 18A and 18B respectively provided on the left and right sides at the lower part of the outer surface of the wall 7.

The engaging members 18A and 18B have female hooks or snaps 19A and 19B mounted on one end thereof, which female hooks or snaps 19A and 19B are detachably connected to male hooks 20A and 20B positioned opposite the point at which said engaging members 16A and 16B are mounted and secured to the outer surface of the back portion 5. These female hooks 19A and 19B and the male hooks 20A and 20B are engaged with one another when the outerwear 4 is worn and disengaged from one another when the outerwear 4 is received into the bag portion 6. The female hooks 19A and 19B when disengaged from the male hooks 20A and 20B are engaged with male hooks secured to the engaging members 18A and 18B and not shown.

Hooks 21A and 21B engageable with the engaging members 16A and 16B or engaging members 18A and 18B are seccured to the free ends of the carrying bands 15A and 15B.

In the embodiment constructed as described hereinbefore, in wearing the outerwear 4, as shown in FIG. 4, the whole outerwear 4 is worn, the carrying straps 15A and 15B are turned from the shoulders towards the front and the free ends of the carrying straps 15A and 15B are connected to the engaging members 16A and 16B. With this, the outerwear is worn in such a manner that both arms of the wearer are passed between the carrying straps 15A and 15B and the back portion 5. Since at this time, the bag portion 6 is positioned on the back of the wearer with the opening thereof directed upwardly, articles received in the bag portion 6 and pocket 12 may be carried on the back. Since in this case, the load of articles received in the bag portion 6 pulls on the carrying straps 15A and 15B, the outerwear 4 is not pulled rearwardly by the weight of the articles.

Figure 5:
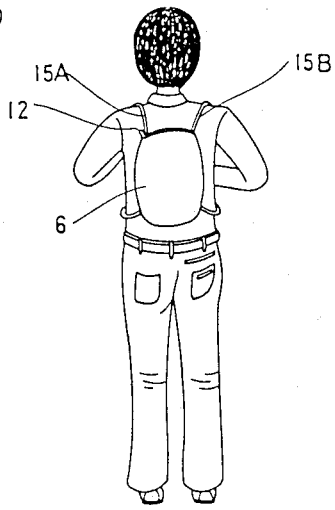
FIGS. 5 and 6 are back and front views, respectively, showing the outerwear and bag in one in accordance with the present invention in actual use.
Figure 6:
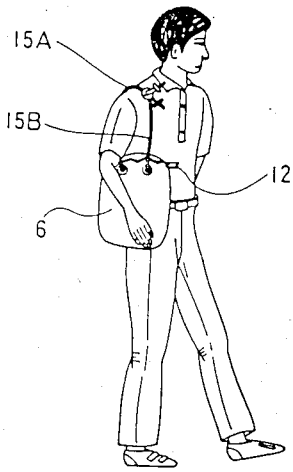

When the outerwear is removed the free ends of the carrying straps 15A and 15B are passed through the through-holes 17A and 17B and pulled out externally of wall 7, while receiving the whole outerwear 4 into the bag portion 6. The pulled out ends of the carrying straps 15A and 15B are connected to the engaging members 18A and 18B. At this time, the second chuck web 10 is brought into engagement with the connector 12, and the connector 12 is opened and closed to provide engagement and disengagement between the main chuck 11 and the second chuck 10 so that the opening of the bag portion 6 may be opened and closed. Even if the whole outerwear 4 is received into the bag portion 6, both the ends of the carrying straps 15A and 15B are stretched directly between the upper and lower ends of the bag portion 6. Accordingly, both arms may be passed through the carrying straps 15A and 15B to carry the bag portion 6 on the back, as shown in FIG. 5, and also, both the carrying straps 15A and 15B may be connected to each other to shoulder them, as shown in FIG. 6.

It should be appreciated in the present invention that buckles or the like can be attached to the carrying straps 15A and 15B and the buckles may be adjusted to adjust the length of the carrying straps 15A and 15B.

As described above, in accordance with the present invention, the outerwear and bag in one can be carried as a knapsack with the outerwear received into the bag portion. Furthermore, since one end of the carrying straps is secured to both ends of the opening of the bag portion through the back portion, the outerwear is not pulled down by the weight of the bag portion.

What is claimed is:

1. In combination, an outer garment including a back portion having an outer surface and an inner surface; an open top bag secured at its top outside the back portion of said garment on said outer surface at the shoulder area thereof;

straps having their upper ends secured to the left and right sides, respectively, on the inner surface of said back portion near the upper end thereof and the opening of said bag;

said bag having an open edge side; through-holes on said open edge side of said bag; and said straps having free ends insertable in said through-holes;

engaging members on said free ends of said straps; and complementary engaging means on the left and right sides at the lower part of the inner surface of said back portion, whereby both arms may be passed through said straps when said garment is folded into said bag, or said bag may be shouldered with said garment therein by connecting said free ends of said straps after passing them through said holes.

2. The combination as defined in claim 1, wherein said bag comprises an inner and an outer wall and closing means along the upper edges and side edge of said walls for closing said bag with said garment folded therein.

3. The combination of claim 2, further including a pocket mounted on the outside of said outer wall.

4. The combination of claim 2, further including releasable fastening means at the lower end of said bag and complementary fastening means in the lower part of said garment.

5. The combination of claim 3, further including releasable fastening means at the lower end of said bag and complementary fastening means in the lower part of said garment.

6. A combined outer garment and bag portion, said garment including a back portion having an outer surface and an inner surface, and said bag portion includes an open top bag secured at its top outside the back portion on said outer surface said garment for the shoulder area thereof; comprising:

a pair of straps having their upper ends secured to the left and right sides, respectively, of the inner surface of said back portion near the upper end thereof and the opening of said bag;

said bag having an open edge side, through holes on said open edge side of said bag, and each of said straps having free ends insertable in said through holes;

engaging members of said free ends of said straps;

first complementary engaging means internally of said back portion of said garment for engagement with said free ends, whereby both arms may be passed through said garment when worn as a jacket; and second complementary engaging means on the left and right sides at the lower part of the inner surface of said back portion, whereby both arms may be passed through said straps when said garment is folded into said bag, or said bag may be shouldered with said garment therein by connecting said free ends of said straps after passing them through said through-holes.

7. The combined garment and bag portion as defined in claim 6, wherein said bag comprises an inner and an outer wall and closing means along the upper edges and side edge of said walls for closing said bag with said garment folded therein.

8. The combined garment and bag portion of claim 7, further included a pocket mounted on the outside of said outer wall.

9. The combined garment and bag portion of claim 8, further including releasable fastening means at the lower end of said bag and complementary fastening means in the lower part of said garment.

10. The combined garment and bag portion of claim 6, further including a pocket mounted on the outside of said open top bag.

11. The combination as defined in claim 6, wherein said straps may be connected together for wearing as a single shoulder strap for said bag with said garment folded therein.

* * * * *